US007161119B2

(12) United States Patent
Reissner et al.

(10) Patent No.: US 7,161,119 B2
(45) Date of Patent: Jan. 9, 2007

(54) MULTIPLE FILAMENT FOR SHEATHED-ELEMENT GLOW PLUGS

(75) Inventors: Andreas Reissner, Stuttgart (DE); Vera Wein, Stuttgart (DE); Rainer Bach, Wiernsheim (DE); Steffen Carbon, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/531,963

(22) PCT Filed: Jun. 26, 2003

(86) PCT No.: PCT/DE03/02131

§ 371 (c)(1),
(2), (4) Date: Apr. 19, 2005

(87) PCT Pub. No.: WO2004/040196

PCT Pub. Date: May 13, 2004

(65) Prior Publication Data

US 2006/0006162 A1 Jan. 12, 2006

(30) Foreign Application Priority Data

Oct. 19, 2002 (DE) ..... 102 48 804

(51) Int. Cl.
*F23Q 7/22* (2006.01)
*H01C 3/16* (2006.01)
*F02P 19/00* (2006.01)

(52) U.S. Cl. ..... 219/270; 219/267

(58) Field of Classification Search ..... 123/297, 123/145 R, 145 A; 219/267, 270; 338/238, 338/239; 361/264, 266
See application file for complete search history.

(56) References Cited

U.S. PATENT DOCUMENTS

| | | | | |
|---|---|---|---|---|
| 1,751,416 | A | 3/1930 | Musgrove | 338/239 |
| 4,603,667 | A | 8/1986 | Imhof et al. | 123/297 |
| 4,787,349 | A | 11/1988 | Hilger | 123/297 |
| 5,468,933 | A * | 11/1995 | Eller | 219/270 |
| 6,064,039 | A * | 5/2000 | Kumada | 219/270 |

FOREIGN PATENT DOCUMENTS

| | | | |
|---|---|---|---|
| DE | 3911492 A1 * | 10/1990 | 219/270 |

* cited by examiner

*Primary Examiner*—Willis R. Wolfe, Jr.
(74) *Attorney, Agent, or Firm*—Kenyon & Kenyon LLP

(57) ABSTRACT

A sheathed-element glow plug, in particular for internal combustion engines, includes a housing, a glow plug situated on the housing and having a heating and regulating filament situated in the glow tube, current being applicable to this heating and regulating filament via a terminal stud situated in the housing. The control filament r the heating filament or the heating and control filament are optionally multiple-coil filaments.

1 Claim, 2 Drawing Sheets

Fig. 1
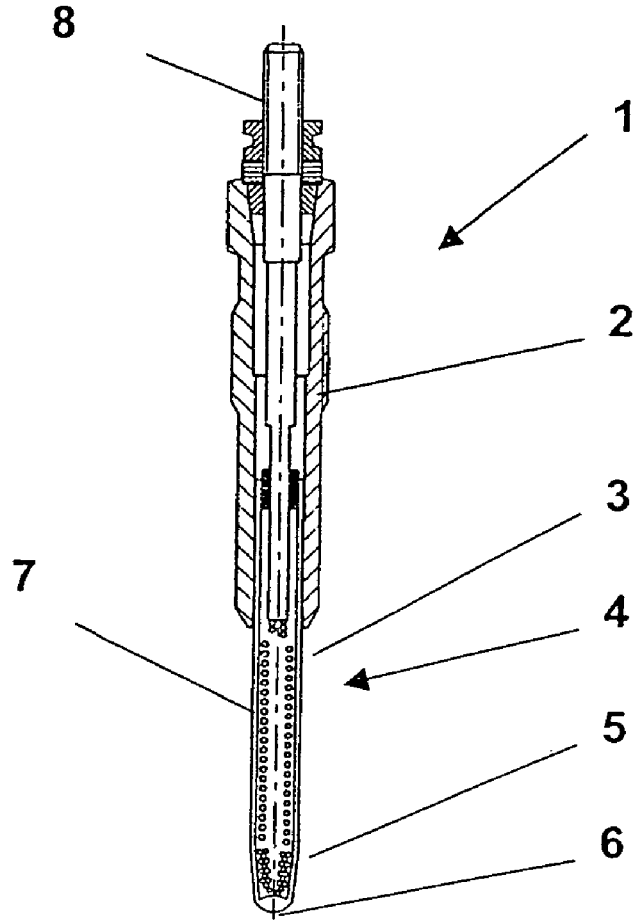
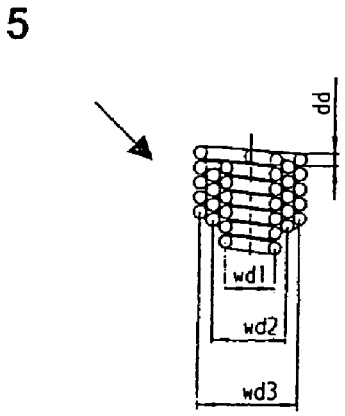
Fig. 2
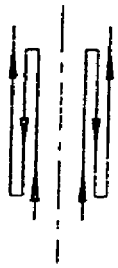
Fig. 3
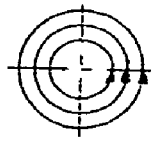
Fig. 4
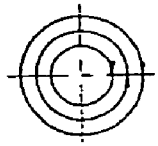
Fig. 5

MULTIPLE FILAMENT FOR SHEATHED-ELEMENT GLOW PLUGS

FIELD OF THE INVENTION

The present invention relates to a sheathed-element glow plug, in particular for internal combustion engines, composed essentially of a housing, a heating element situated on the housing and having a heating and regulating filament situated in the glow tube, current being applicable to this heating and regulating filament via a terminal stud situated in the housing.

BACKGROUND INFORMATION

Internal combustion engines, in particular diesel engines, need an additional heat source for preheating the gas mixture, the intake air, or the combustion chamber for starting and warm-up, in particular at low temperatures.

In passenger cars and sometimes in trucks, sheathed-element glow plugs may be provided and used for this purpose. At least part of the heating element of such a sheathed-element glow plug protrudes into the combustion chamber of the engine and preheats the combustion chamber before the actual engine start and in cold run. In addition, the fuel may ignite on the hot surface of the sheathed-element glow plug.

Sheathed-element glow plugs may be made of a plug housing having a glow tube or a tubular heating element situated thereon. A glow filament, embedded in a compacted magnesium oxide powder, is situated in the tubular heating element made of a material resistant to corrosion by hot gases. The glow filament is usually made of two resistors connected in series: a control filament and a heating filament. The heating filament has an electrical resistance which is almost independent of the temperature, and the control filament is made of a material having a positive temperature coefficient (PTC). The heating filament is welded into the cap of the glow tube on the ground side for contacting. The control filament is contacted to the terminal stud which is connected to the vehicle electrical system.

When a voltage is applied to the glow plug, most of the electric power is converted into heat in the heating filament, and the temperature at the tip of the plug increases steeply. The temperature of the control filament, and thus also its resistance, increase with a time delay. Current consumption and thus the total power consumption of the sheathed-element glow plug are reduced and the temperature approaches a state of equilibrium. Currently sheathed-element glow plugs designed for 12 V to 24 V vehicle electrical systems are commercially available.

SUMMARY OF THE INVENTION

An object of the exemplary embodiment and/or exemplary method of the present invention is to concentrate the heating power on the glow tube tip of the sheathed-element glow plug, making the latter also available for 42 V vehicle electrical systems.

The exemplary embodiment and/or exemplary method of the present invention involves packing more heating wire and thus more electrical resistance into the same space using multiple filaments. Previously, typical sheathed-element glow plugs have only had single coil filaments. In the sheathed-element glow plugs according to exemplary embodiment of the present invention, the heating filaments, the control filaments, or both, may have multiple coil filaments as required.

It is believed that an advantage of packing more heating wire into a tight space is that the heating power may be increased, in particular at the glow tube tip.

More wire in a tight space also means with respect to the heating and control filaments that a higher resistance is achieved and therefore higher voltages are made possible, in particular for those designed for the planned 42-V vehicle electrical systems.

The filaments may be advantageously designed in different ways by producing the individual filaments wound in the same direction or in opposite directions.

In particular when winding the filaments in opposite directions, the advantage is that the overall filament has a reduced outer diameter, and therefore a very compact design is obtained, which also has the advantage that existing glow tubes do not need to be modified.

BRIEF DESCRIPTION OF THE DRAWINGS

FIG. 1 shows a section of a sheathed-element glow plug according to the present invention and having a multiple-coil heating filament at the glow tube tip.

FIG. 2 shows an exemplary embodiment of an exemplary configuration of the multiple-coil heating filament illustrated in FIG. 1.

FIG. 3 shows a schematic diagram of the current flow in the multiple winding of the filaments illustrated in FIG. 2, the filaments being wound in opposite directions.

FIG. 4 shows a schematic top view of filaments wound in the same direction.

FIG. 5 shows a schematic top view with the middle filament wound in the opposite direction.

DETAILED DESCRIPTION

Figure 6:
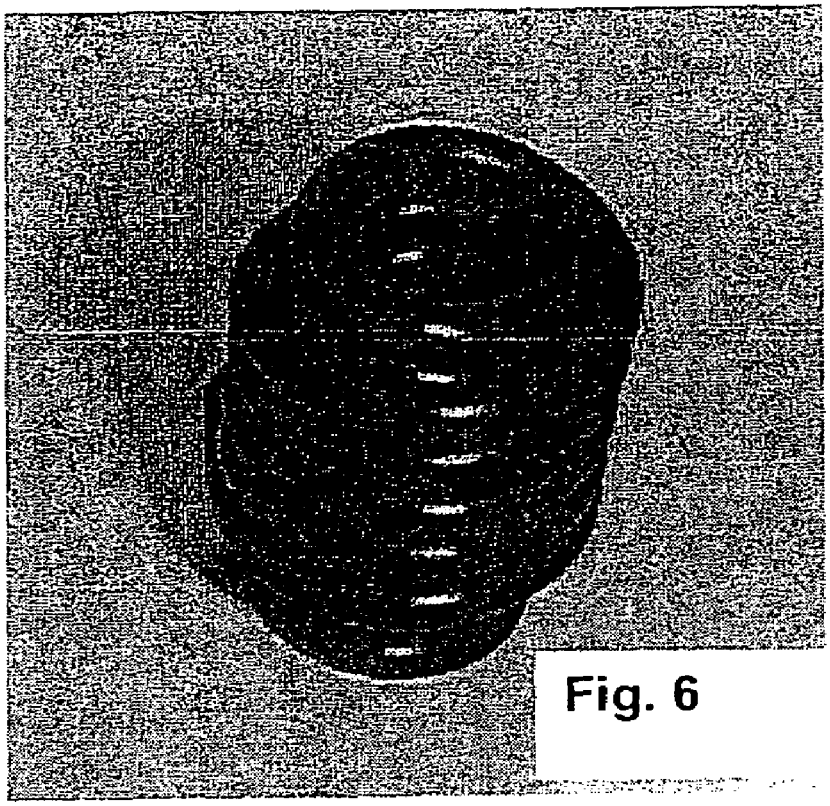
FIG. 6 shows a two-layer example with both filaments wound in the same direction.
Figure 7:
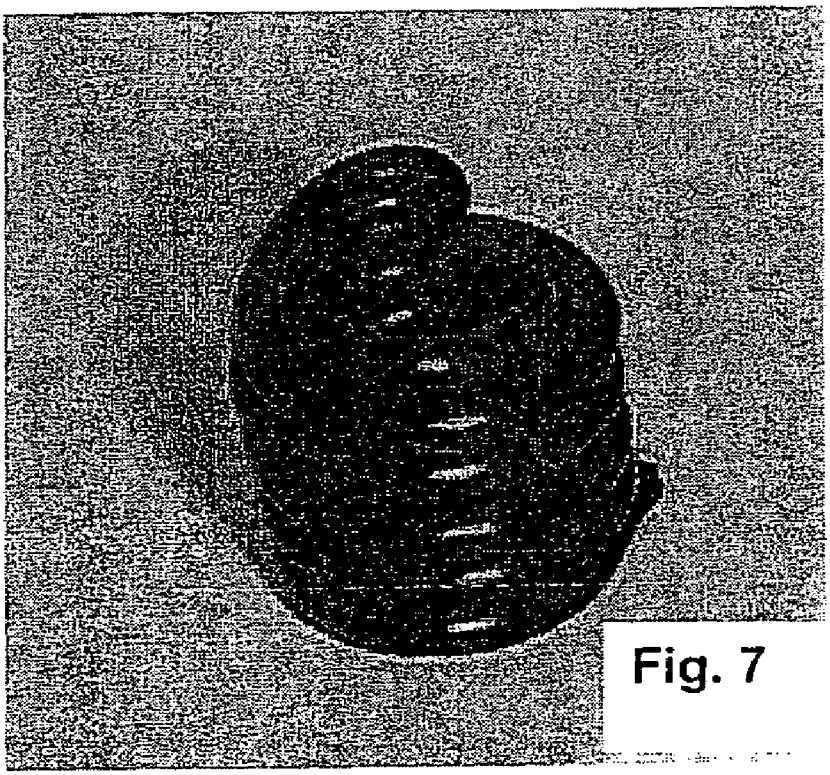
FIG. 7 shows a two-layer example with the two filaments wound in opposite directions.

FIG. 1 shows the structure of a sheathed-element glow plug 1. This sheathed-element glow plug 1 has a housing 2 and a glow tube 3 situated on the housing. A heating and control filament 4 is situated in glow tube 3, heating filament 5 being in the area of glow plug tip 6 and control filament 7 in the part above it. Heating and control filament 4 is supplied with power via a terminal stud 8.

As depicted in FIG. 1, at least one part, either heating filament 5 or control filament 7, is a multiple-coil filament.

In the exemplary embodiment of FIG. 1, heating filament 5 is a multiple-coil filament.

There are different embodiments for implementing the multiple winding of control filament 7 or heating filament 5.

FIG. 2 shows an enlarged depiction of heating filament 5 illustrated in FIG. 1. The manufacturing of heating filament 5 begins with a diameter d1, the other winding having a larger diameter such as d2 being joined directly to the end of the first filament. The third filament having a diameter such as d3 is joined to the end of filament 2, so that the current flows as shown in FIGS. 3 and 4.

The filament layers may be wound in the same direction. In this case, the filaments cannot be wound as tightly, because the individual filaments cross one another. The following inequality applies: wd3>wd2+dd>wd1+dd. Alternatively, the direction of winding may be inverted in each layer. In this case, the additional filament may be in the groove of the adjacent filament. In this way, a smaller outer diameter may be achieved than in the case of the type of winding of FIG. 2.

A high-performance sheathed-element glow plug is obtained by the simple multiple-coil design.

What is claimed is:

1. A sheathed-element glow plug for an internal combustion engine, comprising:

a housing;

a glow tube situated on the housing and having a heating filament and a control filament situated in the glow tube, current being appliable to the heating and regulating filament via a terminal stud situated in the housing, wherein the at least one of the control filament and the heating filament is a multiple-coil filament, a winding diameter of a first filament of the filaments has a smallest diameter and other of the filaments having individual filament diameters have larger winding diameters, and the filaments having the individual filament diameters are wound in opposite directions.

* * * * *